US006404799B1

(12) United States Patent
Mori et al.

(10) Patent No.: US 6,404,799 B1
(45) Date of Patent: Jun. 11, 2002

(54) WATER-COOLING PANEL FOR FURNACE WALL AND FURNACE COVER OF ARC FURNACE

(75) Inventors: Tadashi Mori; Shinjiro Uchida; Koichi Kirishiki, all of Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/647,570

(22) PCT Filed: Sep. 27, 1999

(86) PCT No.: PCT/JP99/05264

§ 371 (c)(1),
(2), (4) Date: Oct. 2, 2000

(87) PCT Pub. No.: WO00/46561

PCT Pub. Date: Aug. 10, 2000

(30) Foreign Application Priority Data

| | | |
|---|---|---|
| Feb. 3, 1999 | (JP) | 11-026767 |
| Feb. 4, 1999 | (JP) | 11-027536 |
| Apr. 12, 1999 | (JP) | 11-104511 |
| Sep. 21, 1999 | (JP) | 11-267773 |

(51) Int. Cl.[7] ..... F27D 1/00; F27D 1/12
(52) U.S. Cl. ..... 373/71; 373/76; 373/74
(58) Field of Search ..... 373/71, 73–76; 266/190, 193, 194

(56) References Cited

U.S. PATENT DOCUMENTS

| | | | | |
|---|---|---|---|---|
| 3,829,595 A | * | 8/1974 | Nanjyo et al. | 373/76 |
| 3,843,106 A | | 10/1974 | Nanjyo et al. | |
| 4,004,790 A | | 1/1977 | Krol et al. | |
| 4,021,603 A | | 5/1977 | Naniyo et al. | |
| 4,079,184 A | * | 3/1978 | Bahout et al. | 373/75 |
| 4,162,061 A | | 7/1979 | Bühler et al. | |
| 4,275,258 A | * | 6/1981 | Harmsen et al. | 373/76 |
| 4,337,927 A | | 7/1982 | Megerle | |
| 4,423,513 A | * | 12/1983 | De Long | 373/76 |
| 4,437,651 A | | 3/1984 | Cordier et al. | |
| 4,676,487 A | | 6/1987 | Kudinov et al. | |
| 4,892,293 A | | 1/1990 | Kato et al. | |
| 5,426,664 A | * | 6/1995 | Grove | 373/76 |

FOREIGN PATENT DOCUMENTS

| | | |
|---|---|---|
| EP | 98720 | 1/1984 |
| FR | 2203966 | 5/1974 |
| FR | 2447401 | 8/1980 |
| JP | 49-118635 | 10/1974 |
| JP | 51-97506 | 8/1976 |
| JP | 56-13597 | 3/1981 |
| JP | 56-29798 | 3/1981 |
| JP | 56-45800 | 4/1981 |
| JP | 56-66680 | 6/1981 |
| JP | 6-51790 | 7/1994 |

* cited by examiner

*Primary Examiner*—Tu Ba Hoang
(74) *Attorney, Agent, or Firm*—Kenyon & Kenyon

(57) ABSTRACT

A water-cooled panel for the furnace wall and furnace roof of an electric-arc furnace is integrally fabricated of refractory bricks arrayed on the furnace inner wall in multiple regularly spaced rows to be exposed at the end surfaces and cooling water pipes installed between the rows of refractory bricks (2). A furnace exterior side of the refractory bricks and a furnace interior side of a cooling water pipe are overlapped in a vertical direction of the water-cooled panel, and the cooling water pipe is provided in between an upper and lower side of refractory bricks.

16 Claims, 9 Drawing Sheets

WATER-COOLING PANEL FOR FURNACE WALL AND FURNACE COVER OF ARC FURNACE

TECHNICAL FIELD

This invention relates to a water-cooled wall and roof panel for installation in an electric-arc furnace used for melting metal material and refining molten metal.

BACKGROUND TECHNOLOGY

In electric-arc furnaces used to melt metal materials and refine molten metal up to the mid-1970s, the furnace body was lined with refractory at the inside of shell and the roof used arch-like refractory at the inside of a metal frame called a furnace roof frame. From around the latter half of the 1970s, however, the need to increase productivity led to a rapid increase in electric-arc furnace size. Since electric-arc furnace power consumption rose in proportion, wear and tear on the refractory used in the furnace body and roof increased markedly. The result was higher refractory-related costs and more downtime for refractory repair.

One attempt made to overcome these problems was aimed at extending the refractory service life while minimizing a decrease in electric-arc furnace heat efficiency by using a furnace body cooler constituted as an structure of one or more cooling water pipes and bricks embedded within cast iron or a copper casting (Japanese Unexamined Published Utility Model Application 49-118635). However, in the cooling structure using cast iron, the iron casting of the cooler proper reaches a temperature of 1000° C. at the surface on the furnace interior side. During use for several hundred to one thousand charges, therefore, the casting experiences cracking caused by thermal stress and becomes brittle owing to change in texture. As the cracking and embrittlement proceed, the casting undergoes wear and the bricks within the casting drop out. When the cracks occurring in the casting surface propagate as far as the cooling water pipe(s), water leakage occurs. In the cooling structure using cast copper, wear and cracking do not arise quickly because the copper casting has higher ductility than the iron casting and does not experience texture change. Still, since the bricks are embedded in the panel on the furnace interior side and the pipe or pipes are present behind the bricks, the ends of the bricks on the furnace interior side reach a high temperature that causes them to wear rapidly. The panel proper also has greater weight owing to its larger thickness. The material cost is therefore higher than when cast iron is used, especially in the case of a very large copper casting.

On the other hand, Japanese Unexamined Published Utility Model Application 56-29798 teaches a method for overcoming the foregoing problems by casting a low-melting-point metal such as copper or aluminum around a cooling water pipe so as to branch radially, thereby enhancing cooling capability and preventing propagation of cracks occurring at the casting surface. Calculations show that this method should hold the temperature of the casting of the cooler proper on the furnace interior side to around 500° C. In fact, however, when the cooler is installed at a high thermal load location where slag does not adhere or barely adheres to the casting surface, the surface temperature reaches 1000° C. or higher. Because of this, the problem of texture change and cracking of the casting cannot be overcome. This method also increases cost because complicated fabrication steps are required in order to cast the low-melting-point metal, which has different properties from the cooler proper, around the cooling water pipe.

Because of the texture change and cracking of the casting, along with other problems, the cast cooler of this structure has not come into general use. The most commonly used structure used today is the water-cooled panel used in a furnace having no refractory at its inner surface and constituted as a cooler of welded steel plate structure, steel pipework structure, copper casting structure or welded copper plate structure. The water-cooled panel is helping to reduce refractory wear also in large-size, high-power electric-arc furnaces. (See, for example Japanese Unexamined Published Patent Applications 51-97506, 56-66680 and 56-45800.)

Various ways have also been suggested for increasing the durability of the electric-arc furnace roof. A vertical sectional view of a conventional electric-arc furnace is shown in FIG. 13. The top of the shell 21 of the electric-arc furnace is closed by an openable roof 23 made of refractory and formed with electrode insertion holes 16 for passage of electrodes 22. During operation, the refractory roof 23 incurs fusion damage under high-temperature heating and has to be replaced. This increases cost. In response to this, Japanese Unexamined Published Patent Application 53-107729 teaches the furnace roof shown in vertical section in FIG. 14. All of the furnace roof, except for the inverted cone portion formed with the electrode insertion holes 16 for passage of the electrodes 22, is made of steel plate and the interior of this portion is formed with helical passages 24 to constitute a water-jacket roof 25. The inner surface of water-jacket roof 25 is formed with a metal film 26 of high thermal conductivity and capable of reflecting radiant heat. This structure prolongs the service life of the furnace roof.

Still, owing to the occurrence of cracks with continuing operation of the electric-arc furnace, this water-jacket type furnace roof made of steel plate frequently experiences water leakage from the water jacket. Moreover, in an electric-arc furnace whose wall and roof are formed with water jackets made of steel plate, the amount of heat lost to water cooling accounts for about 10% of the total energy required by the electric-arc furnace. About half of the lost heat is carried away by the roof cooling water. Also in the electric-arc furnace roof, therefore, there is a need to reduce the amount of heat lost to the cooling water without increasing wear of the refractory.

Japanese Unexamined Published Patent Application 50-142709 teaches a roof for an electric-arc furnace that uses an appropriate number of coolers composed of one or more cooling water pipes and bricks embedded in cast iron, cast copper or other such casting. This furnace roof reduces the amount of heat lost to the cooling water. However, the furnace roof of this structure has the same problems as pointed out regarding the furnace body cooler describe earlier. Specifically, the casting of the cooler proper reaches a temperature of 1,000° C. at the surface on the furnace interior side. During use for several hundred to one thousand charges, therefore, the casting experiences cracking caused by thermal stress and becomes brittle owing to change in texture. As the cracking and embrittlement proceed, the casting undergoes wear and the bricks within the casting wear and drop out. When the cracks occurring in the casting surface propagate as far as the cooling water pipe(s), water leakage occurs.

Therefore, like the furnace body cooler, the furnace roof cooler is also susceptible to cracking of the steel plate and the steel pipework portion as well as to the water leakage this causes. Despite such shortcomings, coolers of the welded plate structure and steel pipework structure, known as water-cooled panels, are in general use.

The technologies described in the foregoing attempt to reduce wear of the electric-arc furnace refractory, lower cost and decease downtime for refractory repair by equipping the furnace interior with water-cooled panels which, being of welded steel plate structure, steel pipework structure, copper casting structure or welded copper plate structure, have no refractory on the furnace interior side. Owing to the absence of refractory on the furnace interior side, however, the water-cooled panel must be supplied with a large amount of cooling water to protect the panel proper. Problems therefore persist regarding heat loss to the cooling water and the need for a high-power pump for supplying the cooling water. Against the backdrop of intensifying calls for more efficient energy utilization in order to reduce emission of carbon dioxide—a greenhouse gas that promotes global warming—a need therefore exists for a water-cooled panel for electric-arc furnaces that can lower the amount of heat lost to the cooling water and reduce the amount of power consumed by the pump used to supply the cooling water, without increasing refractory wear.

The conventional furnace body cooler composed of one or more cooling water pipes and bricks integrally embedded in an iron casting (Japanese Unexamined Published Patent Application 49-118635) experiences cracking caused by thermal stress and becomes brittle owing to a change in texture. As the cracking and embrittlement proceed, the casting undergoes wear and the bricks within the casting drop out. In the cooling structure using cast copper, although no cracking arises because of thermal stress and no embrittlement is caused by change in the casting structure, the ends of the bricks on the furnace interior side wear rapidly because they are not cooled.

Although refractory brick dropout can be completely prevented by maintaining the casting in sound condition, the surface temperature of the refractory brick rises above 1,000° C. even after the cooling capability has been upgraded. Moreover, it has not been possible to avoid gradual, progressive oxidative wear of the refractory brick surfaces in a high temperature atmosphere and/or mechanical damage to the refractory bricks under the impact of scrap charged into the electric-arc furnace. Therefore, when brick wear proceeds to the point that the effect of reducing heat loss to the cooling water can no longer be obtained, the water-cooled panel proper has to be removed and replaced. The old water-cooled panel, which cannot be refurbished with new refractory bricks, has to be scrapped. This is another disadvantage.

When the panel is applied to the wall and roof of an electric-arc furnace, slag and other furnace deposits are retained stably on the furnace wall. Loss of heat to the cooling water is therefore lower than in the case of the water jacket type panel. In the case of the furnace roof, however, the slag and other furnace deposits tend to fall into the furnace, making stable retention difficult. This is because the refractory bricks are made smaller in width at their inner ends than at their outer ends and also because of the rectangular shape of the protrusions for stably retaining the slag and other furnace deposits. The slag and other furnace deposits provide a marked heat insulating effect. The reduction of heat loss to the cooling water is therefore less reliable when the panel is applied to the furnace roof than when it is applied to the furnace wall. Moreover, the more frequent exposure of the bricks embedded in the panel to the furnace interior accelerates brick wear.

DISCLOSURE OF THE INVENTION

The present invention was accomplished to overcome the foregoing problems and provides a water-cooled panel for the wall and roof of an electric-arc furnace that reduces heat loss, reduces power needed for cooling water supply, and achieves a service life equal to or longer than a water-cooled panel of welded steel plate structure, steel pipework structure, copper casting structure or welded copper plate structure having no refractory at the furnace inner wall.

The water-cooled panel for the wall and roof of an electric-arc furnace according to this invention is a cast iron, cast steel or copper casting type water-cooled panel integrally fabricated of refractory bricks arrayed on the furnace inner wall in multiple regularly spaced rows to be exposed at the end faces and at least one cooling water pipe installed between the rows of refractory bricks.

In the foregoing structure, the refractory bricks can be embedded with their ends on the furnace interior side projecting from the casting surface, the refractory bricks can be tapered to make the width of their ends on the furnace interior side smaller than the width of their ends on the side opposite the furnace interior side, the refractory bricks can be formed to have rounded corners at their ends on the side opposite the furnace interior side, cushioning material can be disposed between the contacting surfaces of the refractory bricks and the casting, and the casting surface on the furnace interior side can be locally formed with ridges.

In accordance with another feature of the present invention, the water-cooled panel for the wall and roof of an electric-arc furnace wall is a water-cooled panel wherein slits for inserting refractory bricks from the side opposite the furnace interior side are arrayed in multiple regularly spaced rows and at least one cooling water pipe is embedded between the rows of slits, one of the following structures being adopted:

1) The slits for inserting refractory bricks are formed straight to have the same width at the end on the furnace interior side and the end on the side opposite the furnace interior side;
2) The slits are tapered to have smaller width at the end on the furnace interior side than at the end on the side opposite the furnace interior side;
3) The ends of the refractory bricks on the side opposite the furnace interior side are made to project from the casting surface and are secured by metal fasteners provided on the side of the water-cooled panel opposite the furnace interior side;
4) The refractory bricks are secured by multiple recesses formed in projecting portions of the refractory brick on the side opposite the furnace interior side and multiple protrusions formed in refractory brick metal fasteners;
5) The ends of the refractory brick on the furnace interior side are secured to project from the casting surface;
6) Cushioning material is disposed between the refractory bricks and between the contacting surfaces of the refractory bricks and the casting;
7) The casting surface on the furnace interior side is locally formed with ridges.

A water-cooled panel for an electric-arc furnace roof according to the present invention is a panel composed of multiple refractory bricks and one or more cooling pipes for passing cooling water embedded in cast iron, cast steel or copper casting, wherein the refractory bricks project from the cast iron on the furnace interior side, the ends of the refractory bricks projecting on the furnace interior side and the portions thereof embedded in the cast iron are formed in a shape larger than the width of the middle portion, and the surface of the cast iron on the furnace interior side is provided with slag catchers for retaining slag adhering to the furnace roof, water-cooled panels for an electric-arc furnace roof of this structure being contiguously arranged on a frame in ring shape to form an electrode insertion hole at the middle.

BEST MODES FOR CARRYING OUT THE INVENTION

The invention water-cooled panel for use in the wall and roof of an electric-arc furnace will now be explained with reference to the drawings.

Figure 1:
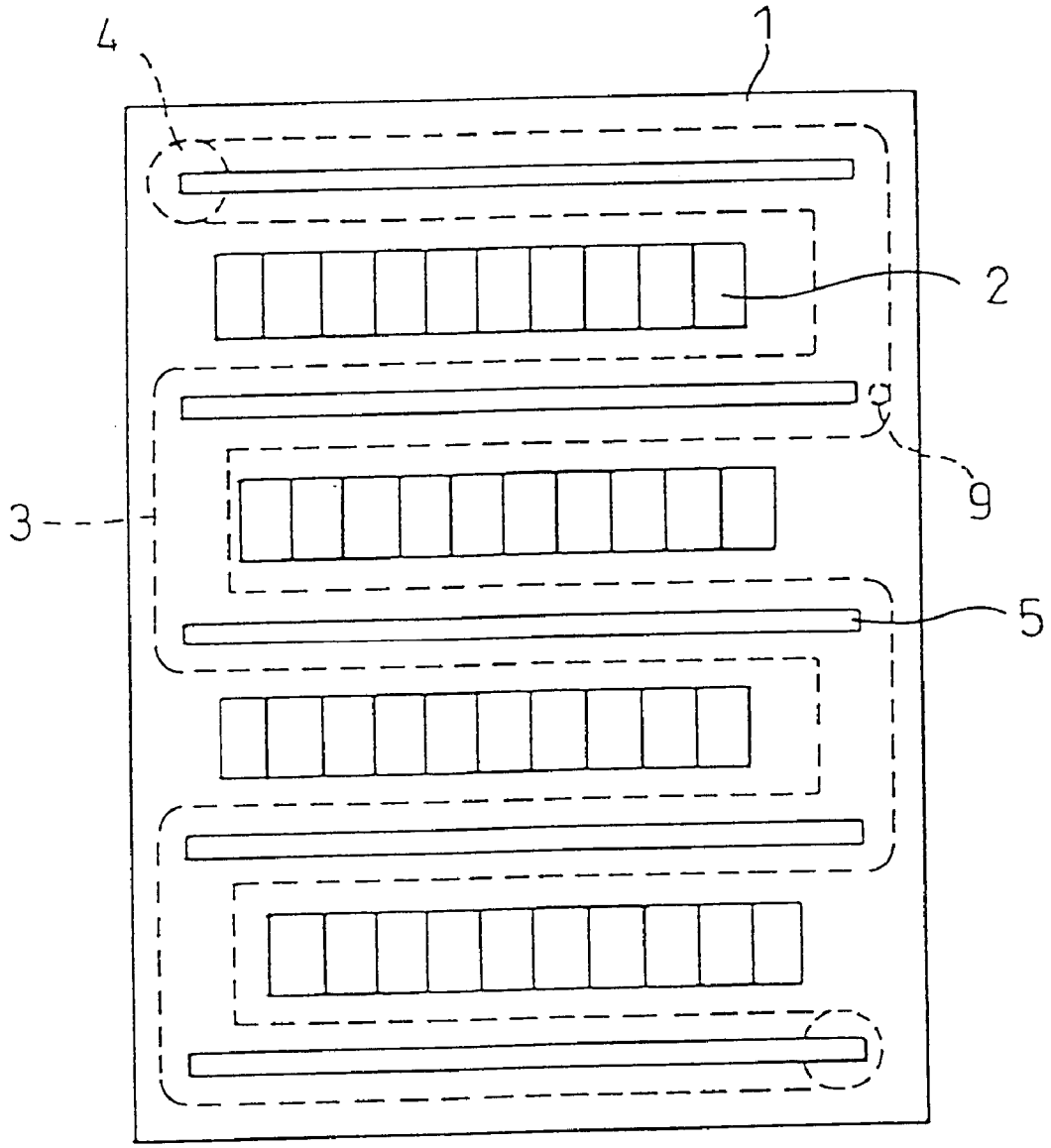
FIG. 1 is a front view of a furnace wall water-cooled panel according to the present invention.
Figure 2:
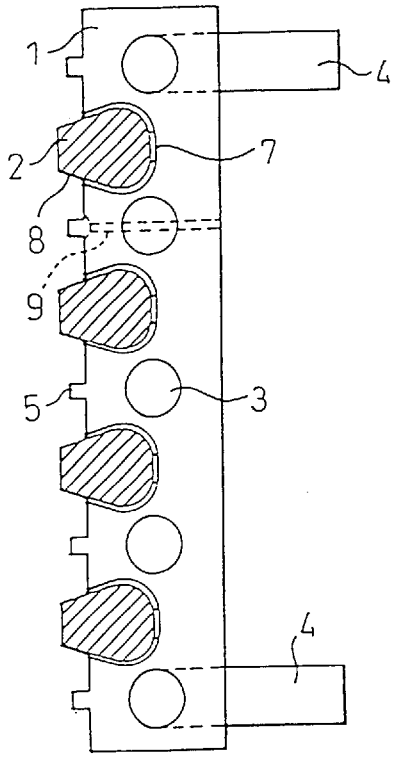
FIG. 2 is a sectional view of a furnace wall water-cooled panel according the present invention.
Figure 3:
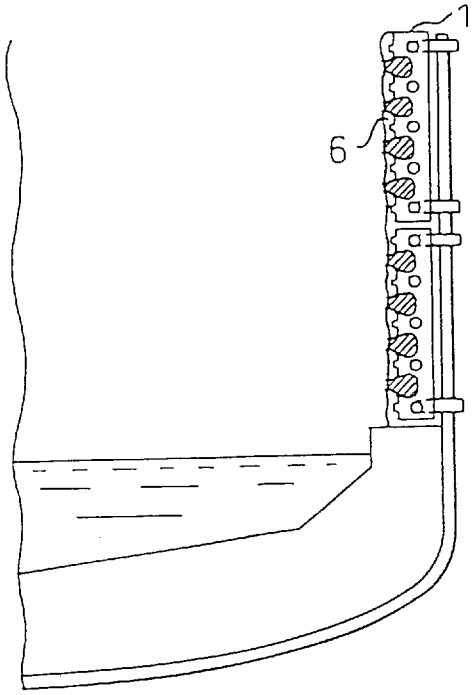
FIG. 3 is a sectional view showing a furnace wall water-cooled panel according to the present invention incorporated in a furnace wall.

FIGS. 1–3 show a water-cooled panel 1 for use in the wall and roof of an electric furnace that is an embodiment of the present invention. Water inlet/outlet pipes 4, rows of refractory bricks 2 and a unitary cooling water pipe 3 installed between the rows of refractory bricks 2 are embedded in a casting. The distance between the cooling water pipe 3 and the surface of the casting of the water-cooled panel proper 1 on the furnace interior side is short. The surface of the casting on furnace interior side can therefore be efficiently cooled.

On the furnace interior side, the refractory bricks 2 embedded in the water-cooled panel 1 project from the casting surface into the interior of the furnace. The surface of the water-cooled panel on the furnace interior side is therefore irregular. This permits slag and other furnace molten matter 6 to adhere stably to the surface of the water-cooled panel 1. The adhered slag and other furnace molten matter 6 usually have a heat insulating property on a par with the refractory bricks 2 embedded in the water-cooled panel 1 and can therefore protect the water-cooled panel 1 and help to reduce heat loss.

The refractory bricks 2 embedded in the water-cooled panel 1 are formed with tapered portions 8 so as to make the width of their ends on the furnace interior side smaller than the width of their ends on the side opposite the furnace interior side, whereby the water-cooled panel 1 engages the refractory bricks 2 and prevents them from falling out. Owing to the heat load in the furnace, the refractory bricks 2 reach a high temperature and thermal stress arises because of the restriction of their outer ends (on the side opposite the furnace interior side) by the casting of the water-cooled panel 1. The corners of the refractory bricks at their outer ends, where the stress particularly concentrates, are therefore rounded to relieve the thermal stress.

Ceramic fiber, glass wool, or other such cushioning material 7 is wrapped around the portions of the refractory bricks 2 embedded in the water-cooled panel 1 to absorb the thermal expansion of the casting and refractory bricks 2 of the water-cooled panel 1 and mitigate the compressive stress acting on the casting and the refractory bricks 2.

The surface of the water-cooled panel 1 on furnace interior side is locally formed with ridges 5. The ridges 5 have an effect similar to that of the portions of the refractory bricks 2 that project from the surface of the water-cooled panel 1 into the interior of the furnace. When the ends of refractory bricks 2 projecting on the furnace interior side are knocked off by the impact of scrap charged into the electric-arc furnace, the ridges 5 operate in place of the projecting ends of the refractory bricks 2 on the furnace interior side to stably retain slag and other furnace molten matter 6. By reference numeral 9 is designated a thermocouple for monitoring the temperature at the furnace inner surface.

Figure 6:
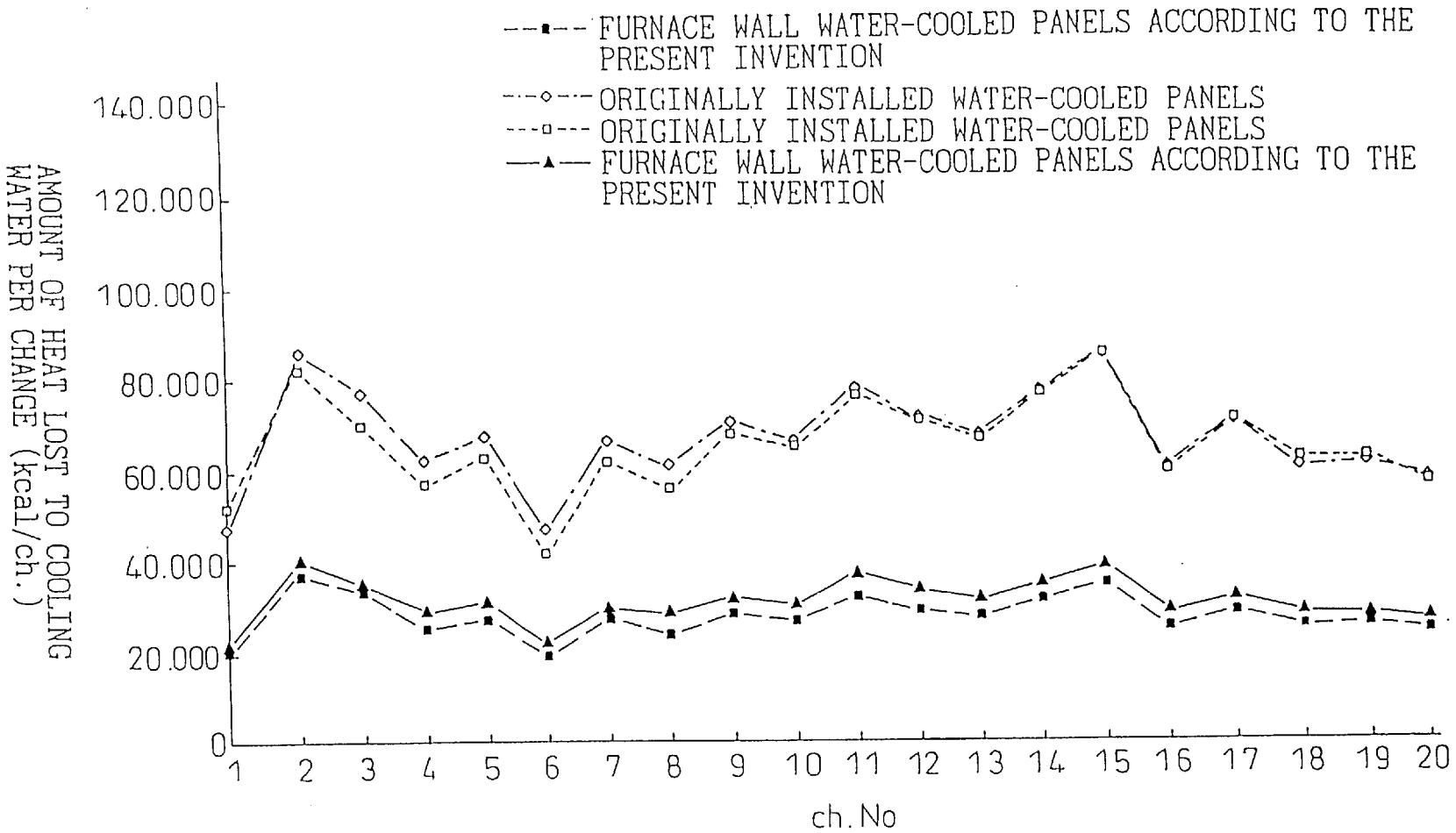
FIG. 6 is a graph showing the amounts of heat lost to cooling water per charge by two invention furnace wall water-cooled panels installed in a D.C. electric furnace to replace two of the originally installed water-cooled panels and the corresponding amounts of heat lost by two originally installed water-cooled panels in the vicinity thereof.

Cast iron water-cooled panels for an electric-arc furnace wall according to the present invention were installed in an electric-arc furnace at an actual facility. The electric-arc furnace was originally equipped with multiple steel pipework structure water-cooled panels having no refractory at the furnace inner wall. Two of these were replaced with electric-arc furnace wall water-cooled panels according to the present invention and the amounts of heat lost to the cooling water were compared. Thermocouples were installed for measuring the temperature of the surface of the cast iron of the water-cooled panels at the furnace interior side. The amounts of heat carried away by the cooling water per charge during operation of the two types of water-cooled panels are shown in FIG. 6. The amounts of heat lost to the cooling water by the electric-arc furnace wall water-cooled panels according to the present invention were about one-half the amounts lost by the originally installed water-cooled panels. The surface temperatures of the invention water-cooled panels on the furnace interior side did not reach 700° C., the temperature at which change in the texture of the cast iron of the water-cooled panel begins. Even after experiencing 1,000 charges, the castings of the water-cooled panels 1 underwent no change in texture and the refractory bricks embedded in the water-cooled panel suffered no wear, dropout or the like.

Figure 4:
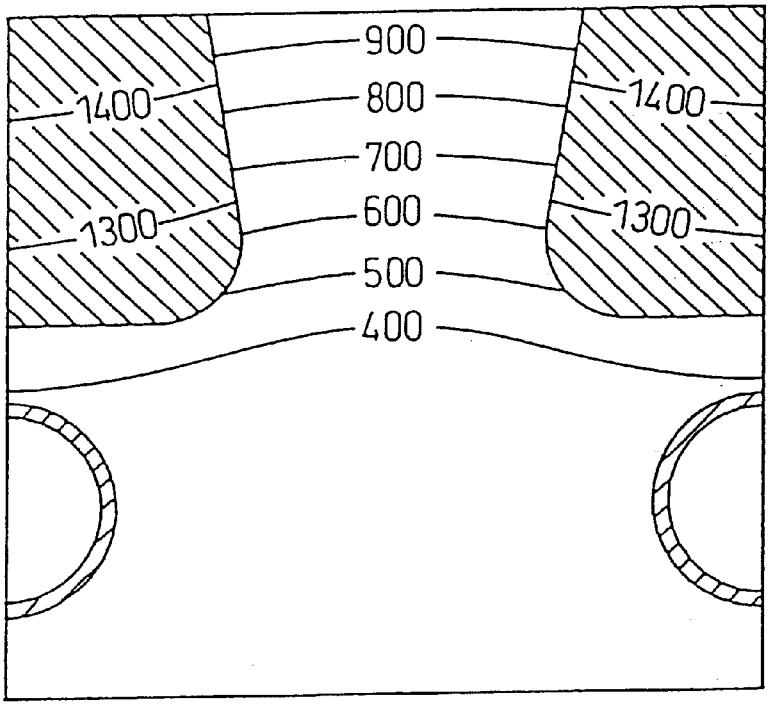
Fig. 4 PRIOR ART
FIG. 4 a sectional view showing temperature distribution in a conventional furnace wall water-cooled panel during use.
Figure 5:
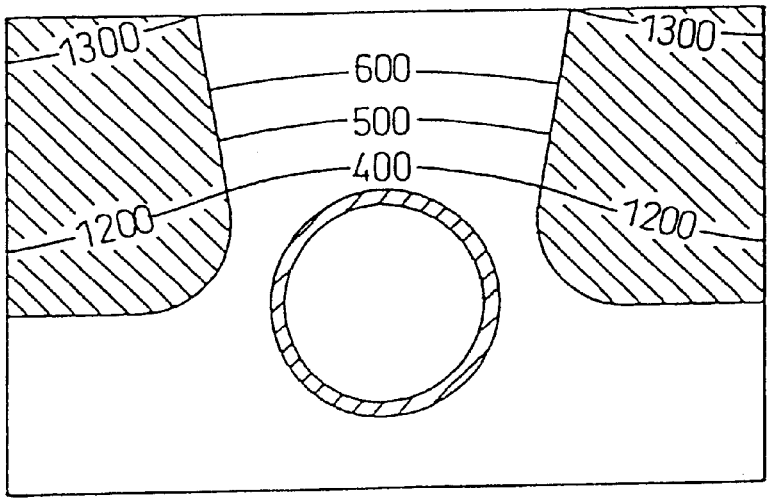
FIG. 5 is a sectional view showing temperature distribution in an invention furnace wall water-cooled panel during use.

The cast iron or cast steel of the conventionally structured water-cooled panels reached around 1,000° C. at the surface on the furnace interior side (see FIG. 4), while the surface temperature of the cast iron of the invention panels on the furnace interior side was 700° C. or lower (see FIG. 5). In the case of cast iron or cast steel, the transformation point is in the vicinity of 700° C. Change in texture and decrease in strength occurs when the temperature exceeds the transformation point. The water-cooled panel according to the present invention can prevent such change in texture and attendant wear because it can hold the surface temperature of the cast iron on the furnace interior side to 700° C. or lower. Owing to its enhanced cooling capability, moreover, it can prolong the service life of the refractory bricks by lowering their temperature at their ends on the furnace interior side.

Figure 7A:
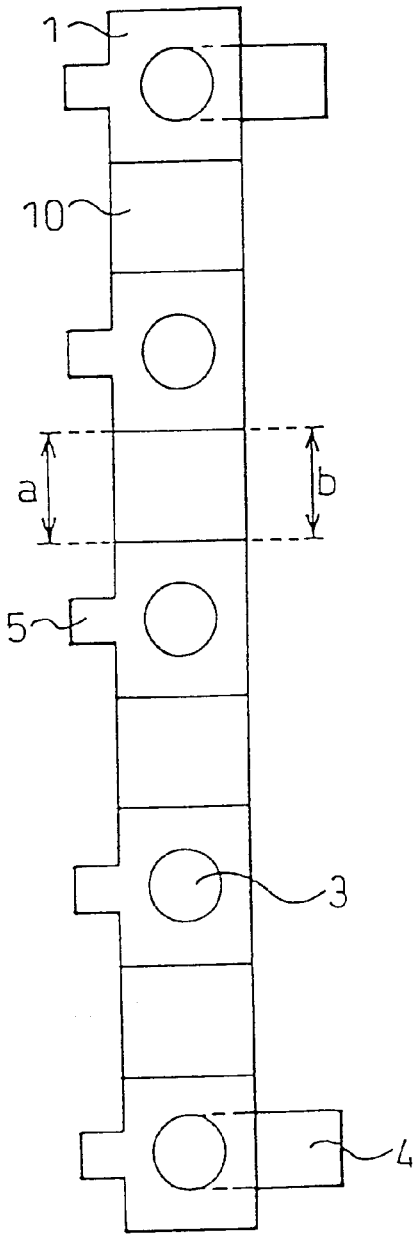
FIG. 7 is a set of diagrams showing sectional views of invention furnace wall water-cooled panels before insertion of refractory bricks into slits, FIG. 7(*a*) showing a water-cooled panel formed with straight slits and FIG. 7(*b*) showing a water-cooled panel formed with tapered slits.
Figure 7B:
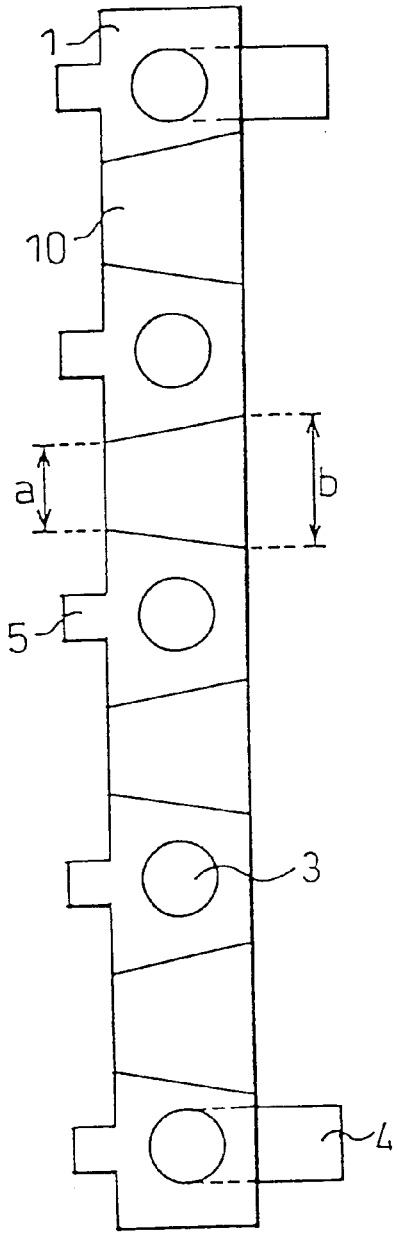

Other embodiments of the present invention are shown in FIG. 7. In these embodiments the water-cooled panel 1 for the wall and roof of an electric-arc furnace, the cooling water pipe 3 formed unitarily with the water inlet/outlet pipes 4 is embedded between rows of slits 10 for insertion of the refractory bricks 2. The distance between the cooling water pipe 3 and the inner surface of the casting of the water-cooled panel 1 is short. The surface of the casting on furnace interior side can therefore be efficiently cooled.

The slits 10 formed in the water-cooled panel 1 for insertion of the refractory bricks 2 can be formed straight, i.e., so that the width a of the slits 10 at the end on the furnace interior side is the same as the width b at the end on the side opposite the furnace interior side (a=b), as shown in FIG. 7(*a*), or can be tapered, i.e., so that the width a of the slits 10 at the end on the furnace interior side is smaller than the width b at the end on the side opposite the furnace interior side (a<b), as shown in FIG. 7(*b*). Therefore, a refractory brick 2 that has incurred oxidative wear or mechanical wear by scrap impact can be easily replaced.

Figure 8A:
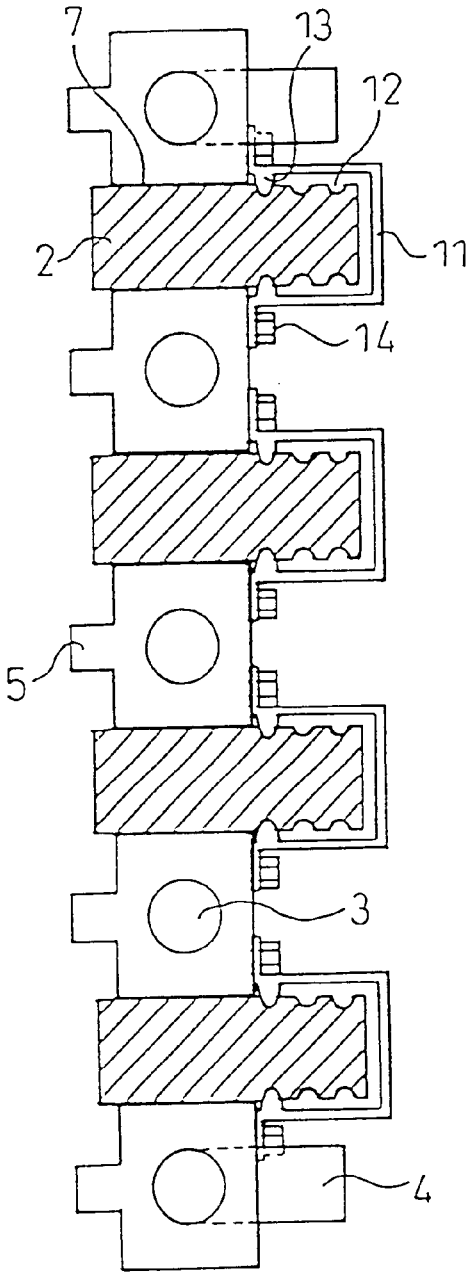
FIG. 8 is a set of diagrams showing sectional views of invention furnace wall water-cooled panels, FIG. 8(*a*) showing refractory bricks secured in straight slits and FIG. 8(*b*) showing refractory bricks secured in tapered slits.
Figure 8B:
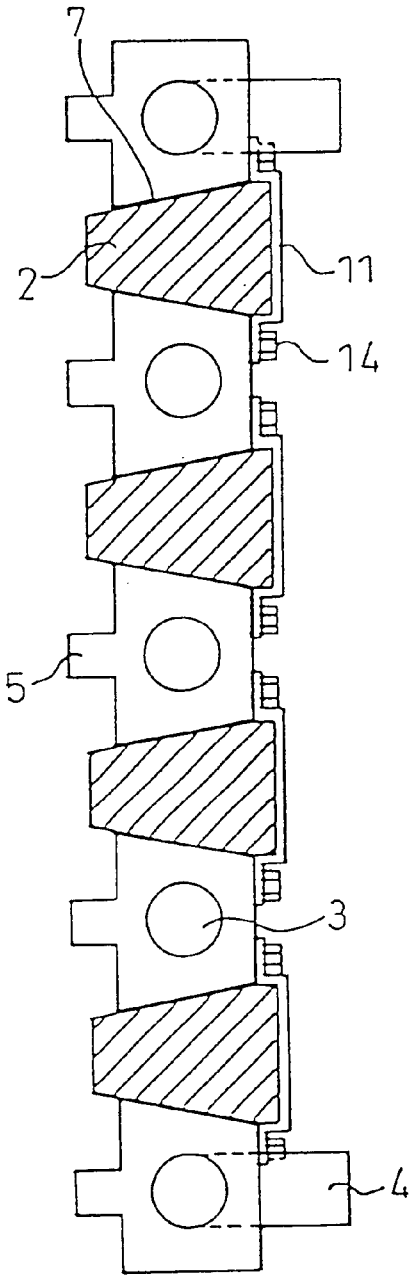

As shown in FIG. 8(*a*) and FIG. 8(*b*), the refractory bricks 2 inserted into the slits 10 of the water-cooled panel 1 project from the casting surface at their ends on the side opposite the furnace interior side and the projecting portions are supported and secured by metal fasteners 11 fixed on the side of the water-cooled panel opposite the furnace interior side by bolts 14. The refractory bricks 2 are therefore prevented from falling out on the side opposite the furnace interior side owing to vibration etc. of the electric-arc furnace.

When the slits 10 are tapered, the refractory bricks 2 inserted into the slits 10 of the water-cooled panel 1 are engaged by the slits 10 and prevented from falling out to the furnace interior side. When the slits 10 are straight, the projecting portions of the refractory bricks 2 on the side opposite the furnace interior side are formed with multiple recesses 12 and the metal fasteners 11 are formed with multiple protrusions 13 that fit into the recesses 12 to secure the refractory bricks 2 and prevent them from falling out to the furnace interior side.

Further, when the slits 10 are straight, the recesses 12 can be formed in the refractory bricks 2 in multiple rows in the direction of refractory brick 2 projection. Then, by pressing the refractory bricks 2 toward the furnace interior side as appropriate in light of their wear condition and then fitting the protrusions 13 of the metal fasteners 11 into the recesses 12, the water-cooled panel 1 can be quickly restored to the initial state at the start of use without replacing the refractory bricks 2.

Figure 9:
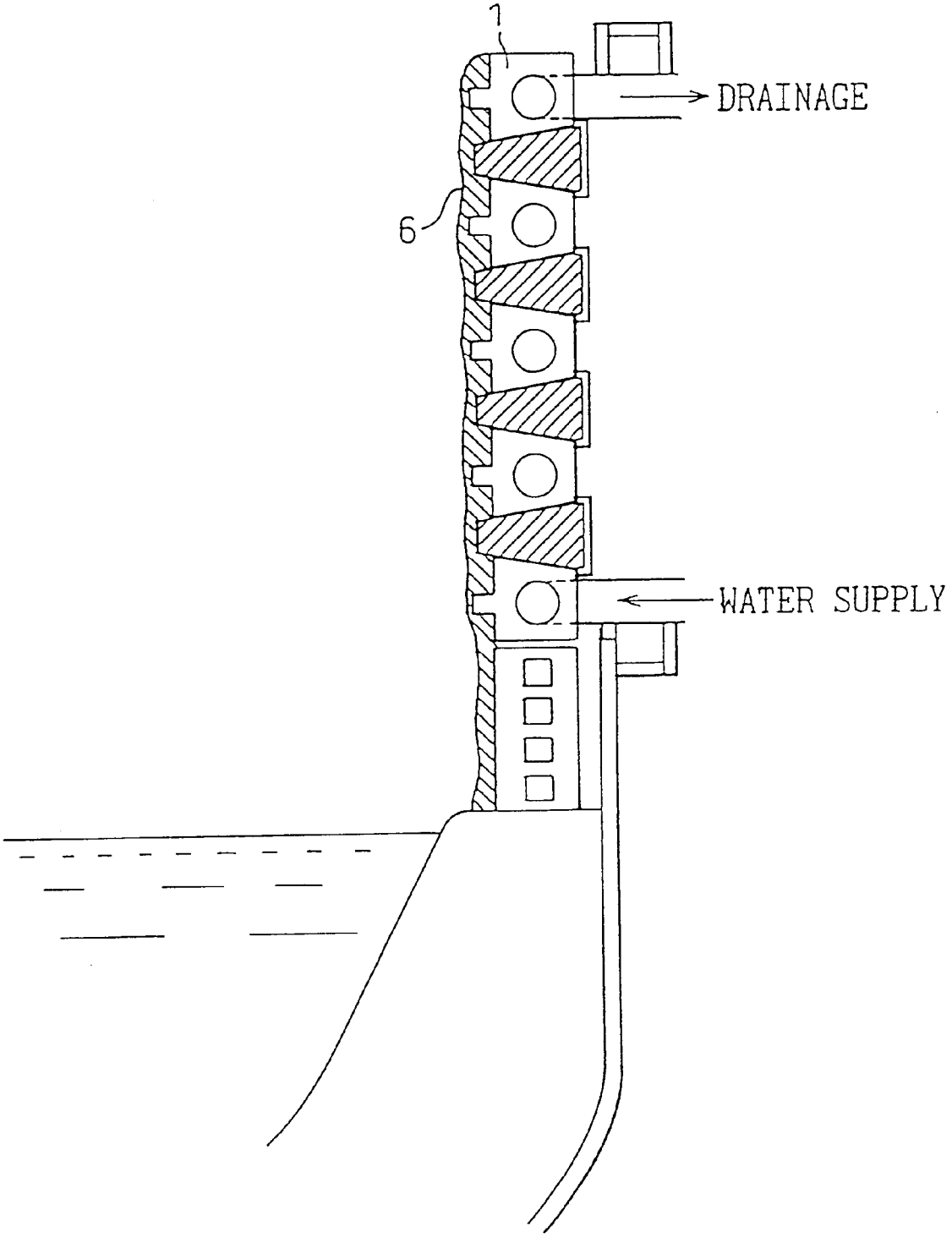
FIG. 9 is a sectional view showing a furnace wall water-cooled panel according to the present invention incorporated in an electric-arc furnace.

The refractory bricks 2 inserted into the slits 10 of the water-cooled panel 1 are inserted so that their ends on the furnace interior side project from the casting surface of the water-cooled panel 1 toward the furnace interior. The surface of the water-cooled panel 1 on the furnace interior side is therefore irregular so that, as shown in FIG. 9, slag and other furnace molten matter 6 can adhere stably. The adhered slag and other furnace molten matter 6 usually have a heat insulating property on a par with the refractory bricks 2 and can therefore protect the water-cooled panel 1 and help to reduce heat loss.

Ceramic fiber, glass wool, or other such cushioning material 7 is wrapped around the portions of the refractory bricks 2 inserted into the slits 10 of the water-cooled panel 1 to absorb the expansion of the casting and refractory bricks 2 of the water-cooled panel 1 and mitigate the compressive stress acting on the casting and the refractory bricks 2.

The surface of the water-cooled panel 1 on the furnace interior side is locally formed with ridges 5. The ridges 5 have an effect similar to that of the refractory bricks 2 inserted so that their ends on the furnace interior side project from the casting surface of the water-cooled panel 1 toward the interior of the furnace. When the ends of the refractory bricks 2 projecting on the furnace interior side have worn down, the refractory bricks 2 are pressed inward. Otherwise the slag and other furnace molten matter 6 are stably maintained by the ridges 5 instead of the projecting portions of the refractory bricks 2 until the refractory bricks 2 are replaced.

The furnace roof water-cooled panel will now be explained.

Figure 10:
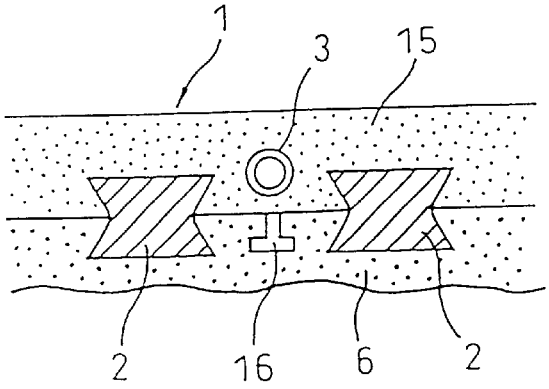
FIG. 10 is a vertical sectional view of a water-cooled panel for an electric-arc furnace roof according to the present invention.

FIG. 10 is a vertical sectional view of a water-cooled panel for an electric-arc furnace roof according to the present invention. Cast iron is used as the matrix of the casting in the illustrated example. The water-cooled panel 1 has refractory bricks 2 embedded in cast iron 15. Each refractory brick 2 projects from the cast iron 15 on the furnace interior side and the end thereof on the furnace interior side is formed in a flared shape larger than the width of the middle portion at the furnace interior side surface of the cast iron so as to reliably retain then slag and other furnace molten matter 6 adhering to the furnace interior side of the furnace roof in cooperation with slag catchers 16. On the other hand, the portions of the refractory bricks 2 embedded in the cast iron 15 are formed to about the same size as the furnace interior side ends so as to prevent dropout from the cast iron 15 and promote heat conduction between the refractory bricks 2 and the cast iron 15. The refractory bricks 2 are therefore preferably formed to have a sectional shape like that of a pulley. Highly spalling-resistant magnesia carbon, for example, is used as the material of the refractory bricks 2.

A cooling water pipe 3 for passing cooling water is embedded in the cast iron 15. Metal slag catchers 16 of a shape for capturing slag are installed, such as by embedment, on the furnace interior side of the cast iron 15 for retaining slag and other furnace molten matter 6 adhering to the furnace interior side of the furnace roof. Causing slag to adhere stably to the furnace roof lowers the temperature of the surface of the furnace roof on the furnace interior side.

Figure 11:
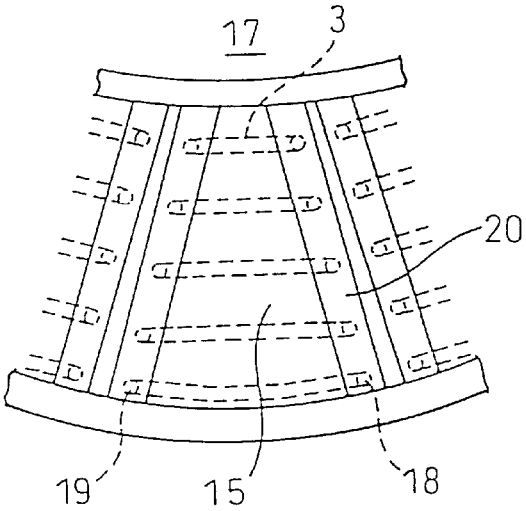
FIG. 11 is a plan view showing part of a furnace roof formed of panels according to the present invention.
Figure 12:
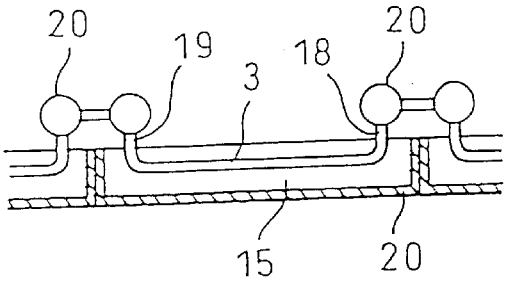
FIG. 12 is a vertical sectional view of a furnace roof formed of panels according to the present invention.
Figure 13:
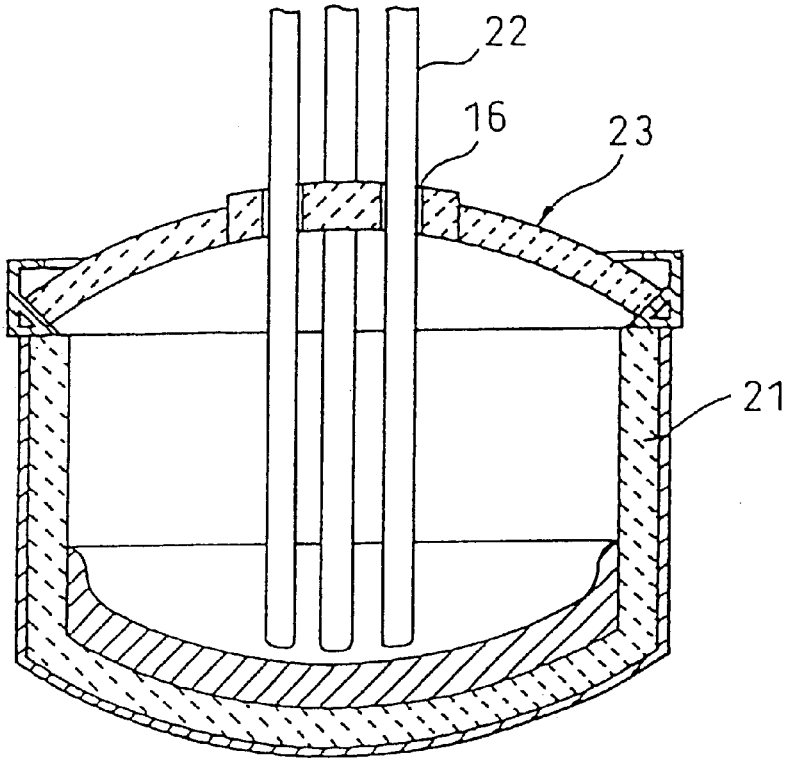
Fig.13 PRIOR ART
FIG. 13 is a vertical sectional view of a conventional electric-arc furnace.
Figure 14:
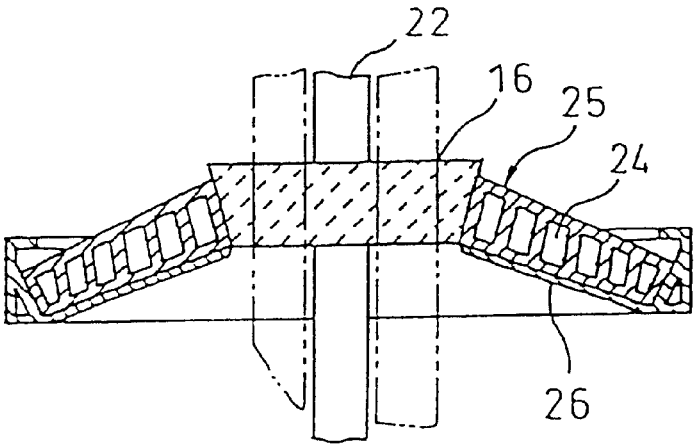
Fig.14 PRIOR ART
FIG. 14 is a vertical sectional view of a conventional water jacket type furnace roof.

FIG. 11 is a plan view and FIG. 12 is a vertical sectional view showing part of a furnace roof formed of panels according to the present invention. The water-cooled panel 1 is formed flat and is formed in the shape of a truncated sector so as to have a shorter edge at the furnace center side than at the furnace periphery side. Panels 1 are arranged contiguously in a ring, thus enabling formation of an electrode insertion hole 17 at the middle. The water-cooled panels 1 are supported by a frame 20. A furnace roof can be fabricated by arranging the flat panels. Fabrication and installation is therefore easier than in the case of the conventional conical furnace roof.

Each water-cooled panel 1 can have a continuous snaking cooling water pipe 3 embedded therein. Otherwise, as shown in FIGS. 11 and 12, a structure can be adopted wherein independent cooling water pipes 3 are embedded in the water-cooled panels 1, the cooling water inlet 18 and the cooling water outlet 19 of each cooling water pipe 3 are directly connected to different header pipes 20, and the header pipes 20 are interconnected. Such connection of the cooling water pipes 3 and the header pipes 20 can be achieved with less fabrication work than in the case of snaking cooling water pipes 3, which require a large number of bending steps. Inexpensive water-cooled panels 1 can therefore be obtained.

The invention electric-arc furnace wall and roof water-cooled panels having the foregoing structures provide the following effects:

(1) Since a water-cooled panel for an electric-arc furnace wall or roof is exposed to radiant heat from the arc and to high-temperature gas, the conventional practice has been to embed the refractory bricks with their one ends exposed on the furnace interior side and to embed the cooling water pipe(s) outward of the refractory bricks, i.e., on the side of the refractory bricks opposite the furnace interior side. In contrast, in the present invention, the cooling water pipe or pipes are installed and embedded between rows of refractory bricks. The distance between the cooling water pipe or pipes and the inner surfaces (surfaces on the furnace interior side) of the casting and the bricks of the water-cooled panel is therefore short and the surfaces of the casting and the bricks on the furnace interior side can be efficiently cooled.

(2) Since the water-cooled panel according to the present invention has its cooling water pipe or pipes disposed between the refractory bricks, it can be made thinner and lighter in weight than the conventional water-cooled panel having embedded refractory bricks and cooling water pipes. Owing to the reduced thickness of the water-cooled panel, the volume of an electric-arc furnace of given size can be increased or the size of an electric-arc furnace of given volume can be decreased. Owing to the weight reduction, the cost of the water-cooled panel can be reduced. The weight reduction results in a particularly notable cost decrease when a copper casting is used because a copper casting is considerably more expensive than an iron casting in terms of material cost.

(3) The water-cooled panel according to the present invention can achieve stable adherence of slag and other furnace molten matter on the surface thereof because its surface on the furnace interior side is irregular owing to the projection of the ends of the embedded refractory bricks on the furnace interior side from the surface of the casting of the panel proper toward the furnace interior. The adhered slag and other furnace molten matter usually have a heat insulating property on a par with the refractory bricks embedded in the water-cooled panel and can therefore protect the water-cooled panel and help to reduce heat loss.

(4) In the present invention, the refractory bricks embedded in the water-cooled panel are tapered so as to make the width of their ends on the furnace interior side smaller than the width of their ends on the side opposite the furnace interior side, whereby the casting constituting the panel proper engages the refractory bricks and prevents them from falling out.

(5) In the present invention, the corners of the refractory bricks at their ends on the side opposite the furnace interior are rounded to relieve thermal stress and cushioning material is wrapped around the refractory bricks. Therefore, thermal expansion of the casting and refractory bricks of the water-cooled panel can be absorbed and compressive stress acting on the casting and the refractory bricks is mitigated.

(6) In the present invention, the surface of the water-cooled panel on the furnace interior side is locally formed with projecting ridges. The ridges have an effect similar to that of the refractory bricks whose ends on the furnace interior side project from the casting surface of the water-cooled panel toward the interior of the furnace. In particular, when the ends of refractory bricks projecting on the furnace interior side have been knocked off by the impact of scrap charged into the electric-arc furnace, the ridges operate in place of the projecting ends of the refractory bricks on the furnace interior side to stably retain slag and other furnace molten matter.

(7) In the present invention, slits for inserting refractory bricks into the water-cooled panel are formed straight to have the same width at the end on the furnace interior side and the end on the side opposite the furnace interior side or are tapered to have smaller width at the end on the furnace interior side than at the end on the side opposite the furnace interior side. A refractory brick whose end face has incurred oxidative wear or mechanical wear by scrap impact can be easily replaced, whereby the service life of the water-cooled panel can be prolonged. Moreover, when the slits are straight, recesses are formed in the refractory bricks on the side opposite the furnace interior in multiple rows in the direction of refractory brick projection. Therefore, by pressing the refractory bricks toward the furnace interior side as appropriate in light of their wear condition and then fitting protrusions of metal fasteners into new recesses, the water-cooled panel can be quickly restored to the initial state at the start of use without replacing the refractory bricks. Dropout of the refractory bricks to the furnace interior side is prevented when the slits for inserting the refractory brick are tapered because the refractory bricks are engaged by the slits, while dropout is prevented when the slits for inserting the refractory brick are formed straight because the multiple protrusions provided on the metal fasteners fit into the multiple recesses provided on the projecting portions of the refractory bricks on the side opposite the furnace interior, thereby securing the refractory bricks.

(8) In the present invention, the refractory bricks are inserted into the slits of the water-cooled panel so that their ends on the furnace interior side project from the casting surface of the panel proper toward furnace interior. The surface of the water-cooled panel on the furnace interior side is therefore irregular so that slag and other furnace molten matter can adhere stably to the surface of the water-cooled panel. The adhered slag and other furnace molten matter usually have a heat insulating property on a par with the refractory bricks and can therefore protect the water-cooled panel and help to reduce heat loss.

(9) In the present invention, cushioning material is wrapped around the portions of the refractory bricks inserted into the slits of the water-cooled panel to absorb thermal expansion of the casting and refractory bricks of the water-cooled panel, thereby mitigating the compressive stress acting on the casting and the refractory bricks.

(10) In the present invention, the surface of the water-cooled panel on furnace interior side is locally formed with ridges. The ridges have an effect similar to that of the refractory bricks inserted so that their ends on the furnace interior side project from the surface of the water-cooled panel toward the interior of the furnace. In particular, when the ends of the refractory bricks projecting on the furnace interior side have been worn by oxidation or scrap impact, the refractory bricks are pressed inward. Otherwise the slag and other furnace molten matter are stably maintained by the ridges instead of the projecting portions of the refractory bricks until the refractory bricks 2 are replaced.

(11) In the present invention, the temperature of the surface of the water-cooled furnace roof can be lowered by stable adherence of slag to the refractory bricks and the scrap catchers. As compared with the conventional water-cooled panel, therefore, the amount of heat carried away by the cooling water can be reliably reduced and the service life of the water-cooled furnace roof can be extended. In addition, the water-cooled furnace roof is fabricated of flat panels and header pipes are interconnected. As this makes the water-cooled roof easier to fabricate and install, an inexpensive water-cooled furnace roof can be obtained.

INDUSTRIAL APPLICABILITY

There can be provided a water-cooled panel for the wall and roof of an electric-arc furnace that reduces heat loss, reduces power needed for cooling water supply, and enables the furnace to achieve a service life equal to or longer than a water-cooled panel of welded steel plate structure, steel pipework structure, copper casting structure or welded copper plate structure having no refractory at the furnace inner wall.

What is claimed is:

1. A cast iron, cast steel or copper casting type water-cooled panel for installation in a wall and roof of an electric-arc furnace, the water-cooled panel for the wall and roof of an electric-arc furnace comprising, a casting and embedded in the casting refractory bricks arrayed in multiple regularly spaced rows to be exposed at their ends on a furnace interior side, a furnace exterior side of the refractory bricks and a furnace interior side of a cooling water pipe are overlapped in a vertical direction of the water-cooled panel, and the cooling water pipe is provided in between an upper and lower side of refractory bricks.

2. A water-cooled panel for the wall and roof of an electric-arc furnace according to claim 1, wherein said casting has a casting surface facing the furnace interior and wherein the refractory bricks are embedded with their ends on the furnace interior side projecting from the casting surface facing the furnace interior.

3. A water-cooled panel for the wall and roof of an electric-arc furnace according to claim 1, wherein the refractory bricks are tapered to make the width of their ends on the furnace interior side smaller than the width of their ends on the side opposite the furnace interior side.

4. A water-cooled panel for the wall and roof of an electric-arc furnace according to claim 1, wherein the refractory bricks are formed to have rounded corners at their ends on the side opposite the furnace interior side.

5. A water-cooled panel for the wall and roof of an electric-arc furnace according to claim 1, wherein said refractory bricks have contacting surfaces surrounded by the casting and wherein cushioning material is disposed between the contacting surfaces of the refractory bricks and the casting.

6. A water-cooled panel for the wall and roof of an electric-arc furnace according to claim 2 wherein the casting surface facing the furnace interior is locally formed with ridges.

7. A cast iron, cast steel or copper casting type water-cooled panel for installation in a wall and roof of an electric-arc furnace, the water-cooled panel for the wall and roof of an electric-arc furnace comprising multiple regularly spaced rows of slits for inserting refractory bricks from a side of the panel opposite a furnace interior side and at least one cooling water pipe embedded between the rows of slits.

8. A water-cooled panel for the wall and roof of an electric-arc furnace according to claim 7, wherein the slits for inserting the refractory bricks are formed straight to have the same width at the end on the furnace interior side and the end on the side opposite the furnace interior side.

9. A water-cooled panel for the wall and roof of an electric-arc furnace according to claim 7, wherein the slits for inserting the refractory bricks are tapered to have smaller width at the end on the furnace interior side than at the end on the side opposite the furnace interior side.

10. A water-cooled panel for the wall and roof of an electric-arc furnace according to claim 7, wherein said panel has a panel surface facing away from the furnace interior and wherein the refractory bricks inserted in the slits project from the panel surface at their ends on the side opposite the furnace interior side and are secured by metal fasteners provided on the side of the water-cooled panel opposite the furnace interior side.

11. A water-cooled panel for the wall and roof of an electric-arc furnace according to claim 7, wherein the refractory bricks inserted into the slits are provided at projecting portions on the side opposite the furnace interior with multiple recesses, metal fasteners for the refractory bricks provided on the side of the water-cooled panel opposite the furnace interior are provided with multiple protrusions, and the refractory bricks are secured by fitting the protrusions of the metal fasteners into the recesses of the projecting portions of the refractory bricks.

12. A water-cooled panel for the wall and roof of an electric-arc furnace according to claim 7, wherein the refractory bricks inserted into the slits are secured with their ends on the furnace interior side projecting from a panel surface facing the furnace interior.

13. A water-cooled panel for the wall and roof of an electric-arc furnace according to claim 7, wherein said refractory bricks have contacting surfaces surrounded by the panel and wherein cushioning material is disposed between the contacting surfaces of the refractory bricks and the panel.

14. A water-cooled panel for the wall and roof of an electric-arc furnace according to claim 7, wherein the casting surface on the furnace interior side is locally formed with ridges.

15. A water-cooled panel for a roof of an electric-arc furnace constituted as a casting type panel having multiple refractory bricks and one or more cooling pipes for passing cooling water embedded in cast iron, cast steel or copper, the water-cooled panel comprising a casting and refractory bricks embedded in the casting that project on a furnace interior side, each refractory brick having a middle portion disposed between an end of such refractory brick projecting on the furnace interior side and a portion thereof embedded in the casting, said middle portion having a width, with said projecting end and said portion embedded in the casting having a shape larger than the width of said middle portion, and slag catchers for retaining slag adhering to the furnace roof provided on a surface of the casting on the furnace interior side.

16. An electric arc furnace having a roof, a plurality of water-cooled panels according to claim 15 mounted on said roof by a frame, wherein said plurality of water-cooled panels are continuously arranged on the frame in a ring shape to form an electrode insertion hole at a middle of the ring shape.

* * * * *

UNITED STATES PATENT AND TRADEMARK OFFICE

CERTIFICATE OF CORRECTION

PATENT NO. : 6,404,799 B1
DATED : June 11, 2002
INVENTOR(S) : Tadashi Mori et al.

It is certified that error appears in the above-identified patent and that said Letters Patent is hereby corrected as shown below:

Title page,
After item [30], Foreign Application Priority Data,
change "Feb. 4, 1999 (JP) ……...11-027536" to
-- Apr. 12, 1999 (JP) ……...11-104511 --.
change "Apr. 12, 1999 (JP) ……...11-104511" to
-- Apr. 21, 1999 (JP) ……...11-113839 --.

Signed and Sealed this

Sixteenth Day of December, 2003

JAMES E. ROGAN
*Director of the United States Patent and Trademark Office*